United States Patent [19]

Lau

[11] 3,964,650

[45] June 22, 1976

[54] BAG FILLING MACHINE HAVING COMBINED INLET VALVE AND LEVEL CONTROL

[75] Inventor: Erwin M. Lau, Dolton, Ill.

[73] Assignee: Black Products Co., Chicago, Ill.

[22] Filed: Oct. 18, 1974

[21] Appl. No.: 515,825

[52] U.S. Cl. ..... 222/450; 141/198; 222/373; 222/457; 251/325

[51] Int. Cl.[2] ..... G01F 11/28

[58] Field of Search ..... 137/242; 141/10, 11, 141/67, 68, 83, 114, 166, 198, 263, 313–317, 374; 222/425, 442, 443, 444, 453, 457, 450, 373; 251/325

[56] References Cited

UNITED STATES PATENTS

| | | | |
|---|---|---|---|
| 2,128,734 | 8/1938 | Schmidt | 141/263 |
| 3,633,692 | 1/1972 | Lau | 141/68 X |
| 3,831,643 | 8/1974 | Lau | 141/68 |

*Primary Examiner*—Richard E. Aegerter
*Assistant Examiner*—Frederick R. Schmidt
*Attorney, Agent, or Firm*—Mason, Kolehmainen, Rathburn & Wyss

[57] ABSTRACT

A bag filling machine has a closed chamber with an inlet valve. The inlet valve includes an outer casing and a slidably mounted inner chamber which, when in its lower position, extends down into the chamber to limit the level of the material passing through aligned openings in the two casings. When the inner casing slides upwardly, the inner casing serves as a gate to cut off the flow of material and at the same time the upward movement of the lower edge of the inner casing permits the material within it to drop down into the chamber. A felt liner is disposed between the two casings.

8 Claims, 8 Drawing Figures

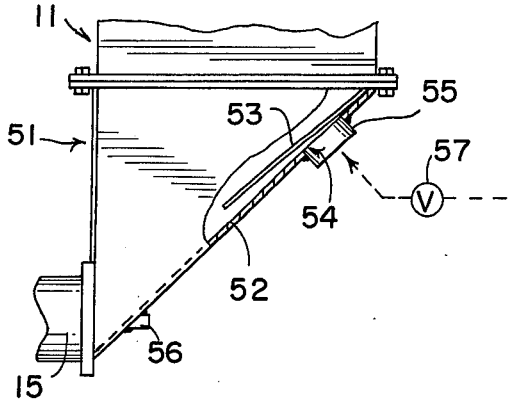
FIG. 7
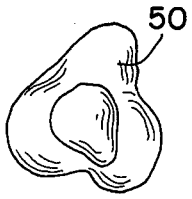
FIG. 6
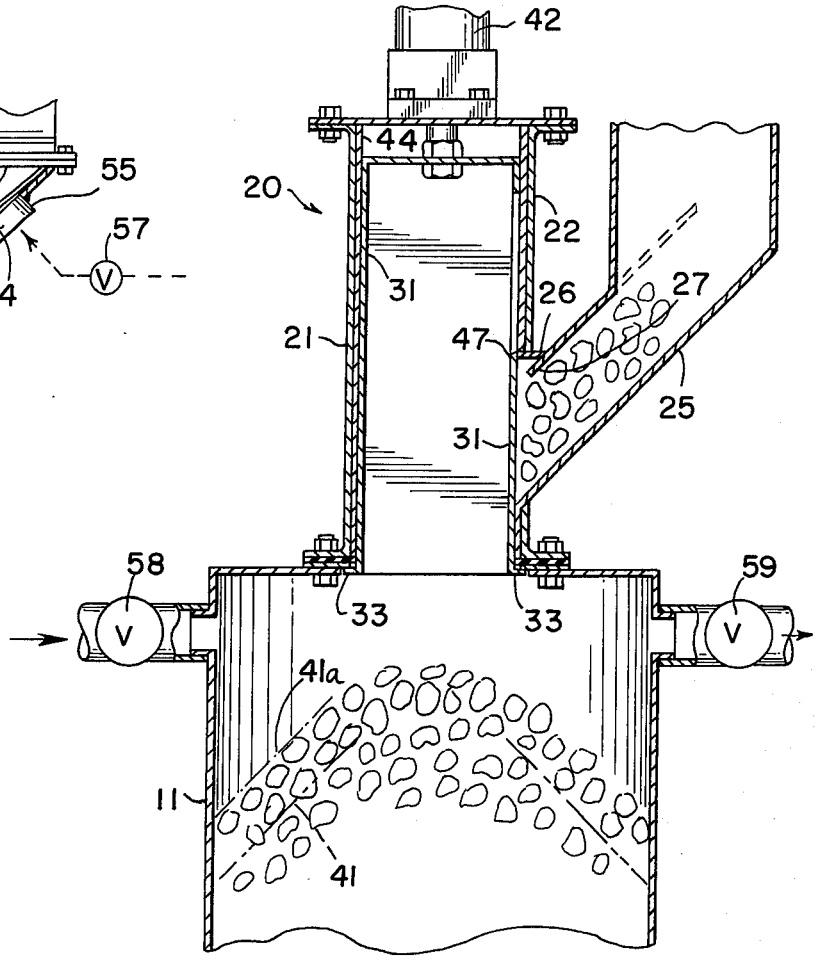
FIG. 4
FIG. 8
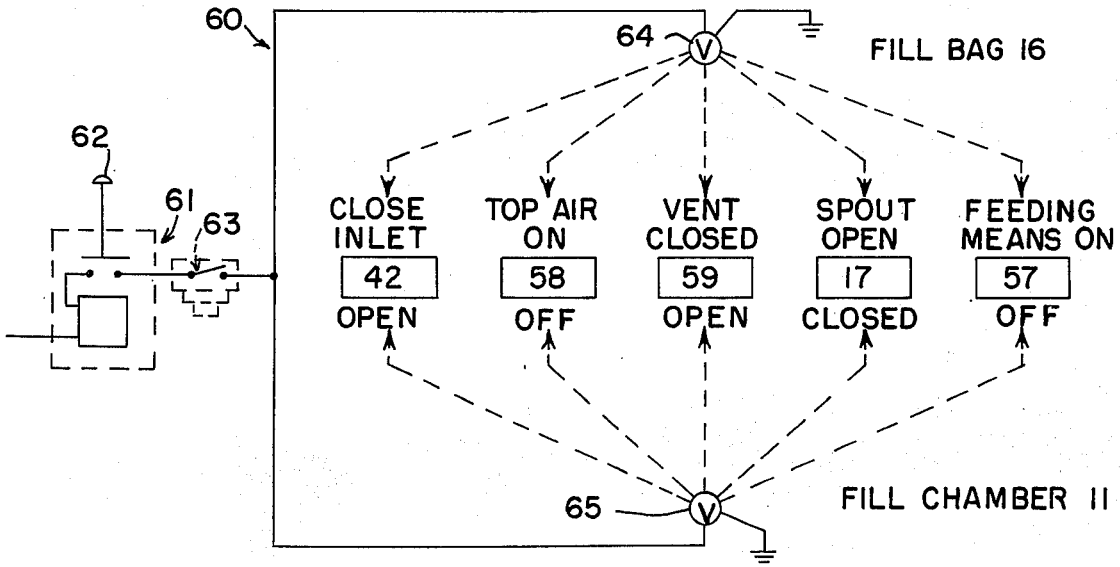

BAG FILLING MACHINE HAVING COMBINED INLET VALVE AND LEVEL CONTROL

This invention relates to a bag filling machine in which the bag to be filled is suspended from a spout which communicates with a chamber which can be closed and pressurized during the filling operation, the chamber having an inlet valve which can be opened between successive filling operations to receive a charge of the particulate material being fed into the bag.

In certain types of inlet valves now used in bag filling machines such as a butterfly-type valve, the material in the chamber tends to block the movement of the valve member into its closed position. This prevents the pressure buildup within the chamber.

My previous U.S. Pat. No. 3,633,692 granted Jan. 11, 1972 and U.S. Pat. No. 3,831,643 granted Aug. 27, 1974 are directed to inlet valve structures designed to avoid the above mentioned blocking problem. The former is more pertinent to the present invention because the gate of the valve slides upwardly through the material, which is not in motion at this time, and penetrates the material level and the gate edge moves into a free space so that there will be no material which would block the engagement of the valve edge with its seat.

According to the present invention, as the gate element moves upwardly, the material level drops so that the particulate material continues to cascade over the gate edge until the opening from the inlet chute is completely blocked. In the case of certain types of irregularly shaped granular material, it makes a difference as to whether the particles are at rest or are in motion when the edge of the gate element penetrates the material level. For instance in the case of metal slugs (alloy ingredients for molten metal) having an irregular shape with a length dimension of from one quarter inch to one-half inch, and a thickness dimension less than half as great, when the material is stationary, there is a possibility that the irregularity in shape will cause a slug to straddle the upwardly moving gate edge and be carried upwardly so that it blocks the movement of the gate into its fully closed position. If the slugs are in motion as the gate edge moves upwardly, there is much less chance that such a balanced condition will occur as will result in straddling. The same applies to much smaller v granules.

Also, the sliding gate of my aforesaid 1972 patent is not too well adapted for use with certain abrasive materials, such as sand and carborundum grits, due to wear of certain guidestrips which require periodic adjustment thereof to take up the wear. The present invention avoids the use of guide strips located within the material.

Apart from the aforementioned advantages over my prior patent, the present invention provides what is believed to be a novel control of the material level to the end that a free space of substantial volume may be provided in the chamber that does not have to be designed to accommodate a valve seat. For example, in some instances it is more economical to provide a pressure chamber which is cylindrical rather than rectangular in cross section.

According to my invention, the inlet valve structure can be mounted on the top wall of the pressure chamber, and the valve element is in the form of a slidably mounted sleeve which, in the valve open position, has a portion extending down into the chamber so as to provide the aforementioned free space. The distance that the sleeve extends into the chamber determines the amount of material within the chamber.

In the case of some materials, the pressure of the top air in the free space is sufficient to cause the material to flow horizontally through the spout and into the bag. In the case of other materials, an air sweep along the bottom wall of the pressure chamber or an air jet near the chamber outlet, or a fluidizing pad is used instead of or in addition to the top air. In either event, it is advantageous in the design of the machine to have latitude as to the amount of free space required to give optimum results. This latitude is provided by providing a separate inlet valve structure mounted on the top of the pressure chamber and which includes a level control device which extends downwardly into the chamber.

My invention is illustrated and described as applied to a weighing type of bag filling machine in which the bag filling operation is automatically discontinued when the weight of the bag contents reaches a predetermined amount. However, my invention is also applicable to a volumetric type of bag filling machine in which the entire contents of the pressure chamber is discharged into the bag, the amount of material in the bag being determined by the capacity of the pressure chamber as determined by the level control. In the case of volumetric operation, the weighing mechanism and the spout valve are omitted.

Other objects, features and advantages of my invention will become apparent as the description proceeds.

IN THE DRAWINGS

FIG. 4 is a view similar to FIG. 3 showing the parts in a changed position.

FIG. 6 is an enlarged elevation of a metal slug which can be operated on by my invention.

FIG. 7 is a vertical section showing the material feeding means at the lower part of the chamber.

FIG. 8 is a circuit diagram illustrating the operation of the claimed invention.

Figure 1:
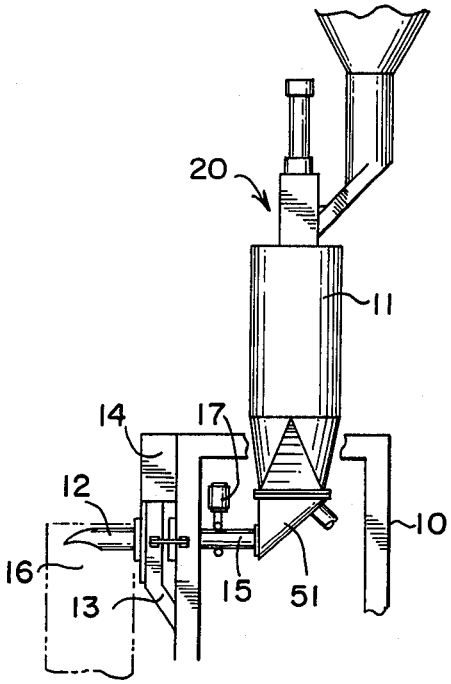
FIG. 1 is an elevational view of a bag filling machine embodying my invention.

With reference now to FIG. 1, the bag filling machine comprises the machine framework 10 which supports a chamber 11 adapted to receive the powdered or granular material to be fed into the bags. A bag-supporting spout 12 communicates with the lower end of the chamber 11 and is mounted at the upper end of a spout-supporting frame 13. The spout-supporting frame may also serve as a support for other equipment not shown, such as a bag clamp and a bag saddle.

The spout-supporting frame 13 is connected to suitable scale mechanism 14, such as that shown in my U.S. Pat. No. 3,540,539 granted Nov. 17, 1970. Since the spout-supporting frame 13 has relative vertical movement with respect to the machine framework 10, a flexible connection is provided between the spout 12 and the chamber 11 in the form of a rubber tube 15.

A valve type bag 16 is slipped over the spout 12 to receive material located in the chamber 11. A spout valve in the form of an air actuated pinch valve 17 engages the rubber tube 15 to cut off the flow of fluidized material through the spout when the contents of the bag reach a predetermined weight, such as 50 pounds.

The inlet valve structure 20 comprises an outer casing 21, of which the top may be open, one sidewall 22, such as the rear wall, and three other walls 23. A vertical supply pipe 24 communicates with a supply hopper not shown, and an inlet chute connects the lower end of the supply pipe with the inlet valve structure 20. A flange 26 extends between the vertical wall 22 and the upper wall of the inlet chute 25 at a point above the lower end 27 of the upper inlet chute wall. This provides a void space 28 above the lower edge 27.

An inner casing 30 is slidably mounted within the outer casing 21 and comprises four sidewalls 31 and a top 32. The top of the inlet valve must be closed and preferably the closure is the top wall of the inner casing 30 because abrasive materials will not contaminate the liner 44, nor corrosive materials attack the piston rod 43.

Figure 3:
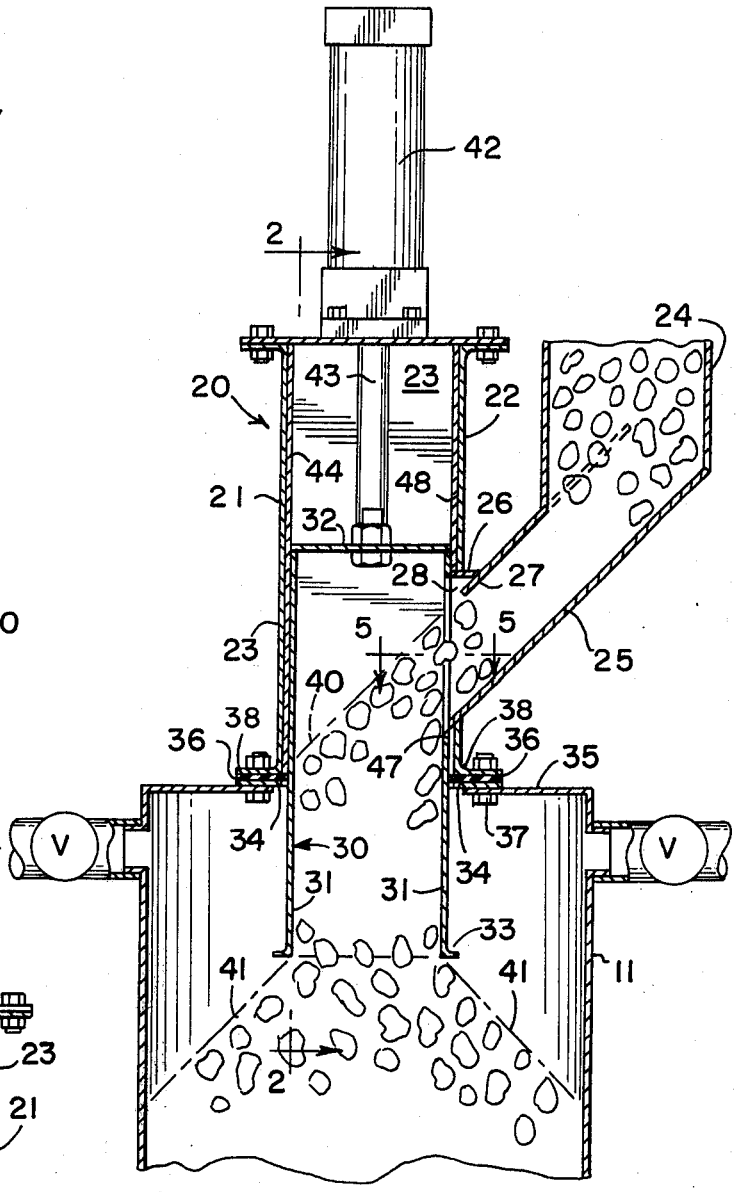
FIG. 3 is a vertical section taken along the line 3—3 of FIG. 2.

Openings are formed in the wall 22 of the outer casing and the corresponding wall 31 of the inner casing 30 which openings are in registry with each other when the parts are in the FIG. 3 position. The lower edges of the sidewalls 31 are provided with lips 33 which engage a rubber gasket 34 to provide a pneumatic seal when the parts are in the FIG. 4 or valve closed position.

The outer casing 21 is mounted on the top wall 35 of the chamber 11. The rubber gasket 34 is confined between tapped strips 36 and the top wall 35 and the parts are drawn up by bolts 37 taking into the tapped strips 36. Then when the flange 38 of the outer casing 21 is fitted over the tapped strips 36 and the bolts 37, the parts are secured together by suitable nuts screwed onto the bolts 37.

Figure 2:
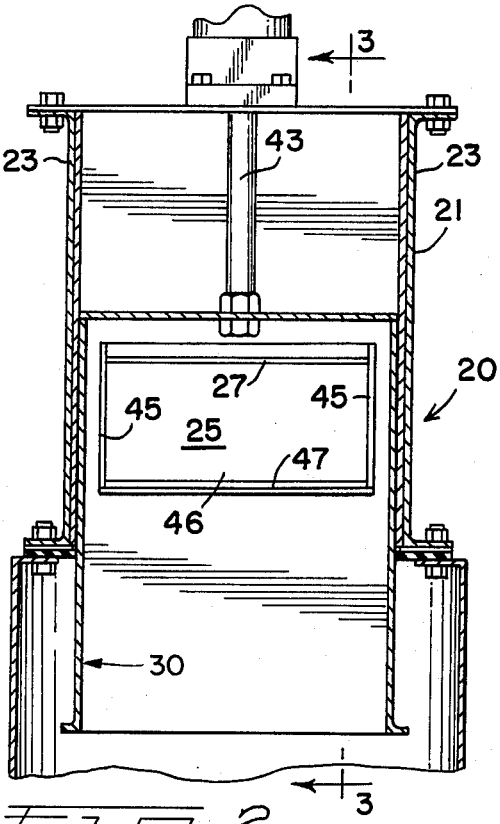
FIG. 2 is an enlarged vertical section of the inlet valve mechanism taken along line 2—2 of FIG. 3.

In operation when the openings in wall 22 and 31 are aligned as shown in FIG. 2 and 3, material from the supply pipe 24 flows down into the inner casing 30 and hence downwardly into the chamber 11. Material will continue to flow into the chamber until the inner casing 30 and the chamber 11 are filled. Broken line 40 represents the material level within the casing and broken line 41 represents the material level within the chamber. The angle of the lines 40 and 41 depends upon the angle of repose of the particulate material being bagged. When the inner casing and chamber have become filled to levels 40 and 41, then the inner casing 30 is moved upwardly into the FIG. 4 position, thus closing the inlet valve. As the lower edge of the inner casing rises, the material contained within the inner casing drops down into the chamber 11 so that when the valve is fully closed the material level within the chamber 11 is represented by the dotted line 41*a*, slightly above the former lever 41.

The inner casing is raised and lowered by a pneumatic cylinder 42 which has a piston 43 connected to the top wall 32 of the inner casing. The side walls 22 and 23 of the outer casing are provided with a suitable wear resistant liner 44. I have found that a hard felt provides a suitable liner in that it provides very little friction, and still will absorb small amounts of abrasive powders without causing wear of the sliding surfaces. "Teflon" (telraflueroethylene (TFE) fluorocarbon resins and fluorinated ethylene-proplyene (FEP) resins) are also suitable.

Figure 5:
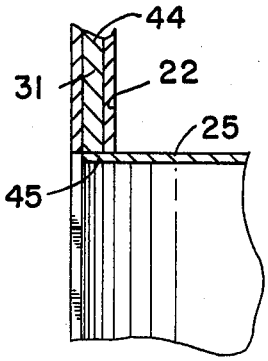
FIG. 5 is a detailed horizontal section taken along line 5—5 of FIG. 3.

At the point where the sidewalls of the inlet chute 25 connect with the inlet valve, the inner edges 45 of the sidewalls extend over the edge of the felt liner 44 (FIG. 5) so as to provide a seal which prevents entry of powder material into the space between the inner sidewall 31 and the outer sidewall 22. Similarly, the lower wall of the inlet chute 25 overlaps the felt liner 44, and the flange 26 in FIG. 3 performs a similar function. The rubber gasket 34 and tapped strip 36 seal the felt from the interior of the chamber 11. Thus the felt is sealed away from the path of the material flow so that the sliding parts are not subjected to wear due to the abrasive character of the materials being fed.

The lower edge of the opening 46 in the inner casing wall 31 is preferably cut at a slant to provide a relatively sharp edge 47 which is operative to throw the material to one side or the other as the edge 47 moves upwardly through the material incident to valve closure. This assures that particles will not rest on a flat and be carried upwardly by the edge in the manner which blocks the full closing of the gate, and thus prevent pressure buildup. Furthermore, the void space 28 assures that the last half inch or so of the gate movement will be through a free space so that any particles which might be resting on the edge 47 will tend to drop into the inner casing 30.

As the inner casing 30 moves upwardly into valve closed position the material being fed will continue to flow over the edge 47 until the latter penetrates the material level 40, although the rate of flow will be somewhat reduced as the area of the opening is reduced. Thus when feeding metal slugs 50 as shown in FIG. 6 which are of very irregular configuration, the fact that the slugs are in motion will tend to prevent them from straddling the sharp edge 47 and being carried upwardly into engagement with the flange 26.

FIG. 7 shows feeding means for causing the material to move from the bottom of the chamber 11 through the flexible tube 15 and into the spout 12. The lower portion 51 of the chamber 11 has a sloping wall 52 so that material tends to slide down the wall surface into the tube 15. Overlying the upper rear portion of wall 52 is a deflector plate 53. An opening 54 is formed in the wall 52 beneath the deflector plate 53 and has a collar 55 to which an air hose may be connected. When low pressure air is forced through the opening 54, say 10 cubic feet per minute, the air will fan out into a sheet which overlies the bottom wall 52 and tends to urge the material out of the chamber and through the spout. Alternatively or additionally, another opening and collar 56 may be provided in the wall 52 at a point opposite the outlet tube 15 through which high pressure air may be blown to create a jet which assists the material in its motion through the outlet tube 15 and spout 12. In the case of some material a fluidizing pad is preferable as described in the aforementioned U.S. Pat. No. 3,633,692. In the case of some materials, no feeding means is required.

The air supply for the feeding means is controlled by a suitable air actuated valve 57 indicated diagrammatically in FIG. 7.

Low pressure air, "top air", is preferably supplied to the top of the chamber to pressurize it during the bag filling stage of the cycle. The top air supply is controlled by a suitable air actuated valve 58, (FIG. 3) such as a double acting air actuated pinch valve, similar to pinch valve 17.

Preferably venting means, including a valve 59 are provided. At the conclusion of the bag filling stage of the cycle and during the chamber filling stage, the vent valve 59 is opened to relieve the pressure within the chamber 11.

The operation is best illustrated by the electric circuit diagram of FIG. 8, although it is understood that an equivalent pneumatic control circuit may be employed to control the supply of actuating air to the cylinder 42 for operating the inlet valve 20, and to the various other valves 58, 59, 17, 57. For clarity, it will be assumed that the air actuated valves are double acting, although in some instances the valve may be single acting, spring biased.

The circuit 60 includes a cycle-initiating relay 61 having a start button 62 and also includes a cycle-terminating switch 63 which is actuated by the scale mechanism 14. When the contents of the bag reaches a predetermined weight, the scale mechanism trips and opens the switch 63 to terminate the bag-filling operation. The circuit 60 also includes a normally closed solenoid valve 64 and a normally open solenoid valve 65. The normally closed solenoid valve 64, when energized, supplies actuating air to the inlet valve cylinder 42 and to the actuating cylinders of the various valves indicated in FIG. 8 to perform the functions indicated by the legends, and which are associated with the bag-filling operation. This operation is initiated by depressing the start button 62 and terminated by the tripping of the scale mechanism.

Then the normally open solenoid valve 65 opens and supplies actuating air to the elements to cause them to perform the reverse function, and the elements remain in this condition until the start button 62 is again depressed.

In the case of volumetric operation the cycle terminating switch 63 is actuated by a timing cam.

Although only a preferred embodiment of my invention has been shown and described herein, it will be understood that various modifications and changes can be made in the construction shown without departing from the spirit of my invention, as pointed out in the appended claims.

The invention claimed is:

1. A bag filling machine adapted for receiving material from a supply means comprising a chamber, a bag-filling spout connected with the lower part of said chamber, an inlet valve for admitting material from a supply source to said chamber, said inlet valve comprising an outer casing mounted on a top wall of said chamber and communicating therewith, an inner casing slidably mounted for movement within said outer casing between an upper and a lower position, the inner casing being of a length such that its lower edge extends downwardly into said chamber when in said lower position to limit the level of material being fed into said chamber in order to provide a free space in the upper portion of said chamber, said outer and inner casings each having an opening which are aligned with each other when said inner casing is in said lower position communicating the interior of said inner casing with said supply source, the wall of said inner casing being imperforate beneath the opening therein to provide an upwardly sliding gate operative to close the opening in said outer casing to cut off the flow of material from said supply source through said opening in said outer casing, the upward movement of said lower edge incident to valve closing permitting the material within said inner casing to drop into said chamber, and means for slidably moving said inner casing between said lower and said upper positions.

2. A bag filling machine as claimed in claim 1 which includes a wear resistant liner between said inner and outer casings.

3. A bag filling machine as claimed in claim 2 which includes an inlet chute extending between said inlet valve and said supply source, the side and bottom walls of said inlet chute being extended into the opening in said outer casing and overlapping said liner, and flange means overlapping said liner at the upper edge of said opening in said outer casing.

4. A bag filling machine as claimed in claim 1 which includes a sloping inlet chute extending between said inlet valve and said supply source, a substantially horizontal flange member extending between the upper edge of said opening in said outer casing and the upper wall of said sloping inlet chute, said upper wall extending downwardly beneath said flange providing a void space above said extended upper wall.

5. A bag filling machine as claimed in claim 1 in which said lower edge of said inner casing is provided with an outwardly extending lip, gasket means adjacent said top wall of said chamber and surrounding the side walls of said inner casing, said lip engaging said gasket when in said upper position.

6. A bag filling machine as claimed in claim 1 which includes cycle initiating means for controlling the movement of said inner casing to an upper valve closed position, and cycle terminating means for controlling the movement of said inner casing to a lower valve open position.

7. A bag filling machine as claimed in claim 6 which includes means, including an air actuated valve, for supplying air under pressure to said chamber, said cycle initiating means controlling the movement of said air actuated valve into open position, and said cycle terminating means controlling the movement of said valve into off position.

8. A bag filling machine as claimed in claim 6 which includes means, including air actuated air supply valve, for causing material in the lower part of said chamber to flow through said spout and into a bag, said cycle initiating means controlling the movement of said air actuated air supply valve into open position, and said cycle terminating means controlling the movement of said valve into off position.

* * * * *